US005848649A

United States Patent [19]

Matsumoto et al.

[11] Patent Number: 5,848,649

[45] Date of Patent: Dec. 15, 1998

[54] FIRE EXTINGUISHER

[75] Inventors: Katsutoshi Matsumoto, Suita; Shigeyuki Shiraishi, Yamato, both of Japan

[73] Assignee: Katsutoshi Matsumoto, Osaka, Japan

[21] Appl. No.: 840,539

[22] Filed: Apr. 22, 1997

Related U.S. Application Data

[62] Division of Ser. No. 735,246, Oct. 22, 1996, Pat. No. 5,676,190, which is a division of Ser. No. 446,051, May 19, 1995, Pat. No. 5,615,743.

[30] Foreign Application Priority Data

| | | | |
|---|---|---|---|
| May 24, 1994 | [JP] | Japan | 6-133811 |
| Jan. 19, 1995 | [JP] | Japan | 7-024781 |
| Jan. 19, 1995 | [JP] | Japan | 7-024782 |
| Mar. 1, 1995 | [JP] | Japan | 7-037050 |

[51] Int. Cl.[6] ..... A62C 37/12

[52] U.S. Cl. ..... 169/26

[58] Field of Search ..... 169/26

[56] References Cited

U.S. PATENT DOCUMENTS

| | | | |
|---|---|---|---|
| 1,939,333 | 12/1933 | Bronander | 169/26 |
| 2,785,759 | 3/1957 | Fleming et al. | 169/75 |
| 2,805,725 | 9/1957 | Bagarozy . | |
| 3,091,365 | 5/1963 | Horner et al. | 169/26 |
| 3,228,474 | 1/1966 | Huthsing | 169/75 |
| 3,229,851 | 1/1966 | Horwitt et al. . | |
| 3,613,793 | 10/1971 | Huthsing | 169/26 |
| 3,915,236 | 10/1975 | Stichling | 169/26 |
| 4,620,598 | 11/1986 | Reeder | 169/74 |
| 5,301,631 | 4/1994 | Vining . | |
| 5,505,266 | 4/1996 | Fujiki | 169/26 |

FOREIGN PATENT DOCUMENTS

| | | |
|---|---|---|
| 910753 | 6/1946 | France . |
| 1107680 | 1/1956 | France . |
| 1535487 | 8/1968 | France . |

*Primary Examiner*—Gary C. Hoge

*Attorney, Agent, or Firm*—Frishauf, Holtz, Goodman, Langer & Chick

[57] ABSTRACT

A fire extinguisher has a pipe member for containing a cylinder filled with liquefied extinguishing gas, and a pusher guide member and a nozzle having an ejection hole formed therein are fitted to upper and lower openings, respectively, of the pipe member. A cylinder receiver to which the cylinder is fitted is mounted to the pusher guide member, and a pusher having a needle provided with a striker pin is movably arranged within the pusher guide member. Axial movement of the pusher is inhibited by a safety plate fitted in a groove formed in the outer peripheral surface of the pusher. In the event a fire breaks out, after removing the safety plate, an extinguishing person strikes the pusher with the fire extinguisher aimed at the origin of the fire, whereupon the pusher moves together with the needle, while compressing a spring interposed between the pusher and the cylinder receiver, and the striker pin of the needle breaks a seal plate of the cylinder, whereby the fire-extinguishing gas in the cylinder fills in a passage defined between the cylinder and the pipe member via a passage formed in the striker pin, the needle and the cylinder receiver, and then ejected from the ejection hole toward the origin of the fire.

3 Claims, 13 Drawing Sheets

FIRE EXTINGUISHER

This is a division of application Ser. No. 08/735,246 filed Oct. 22, 1996, now U.S. Pat. No. 5,676,190 which is a division of Ser. No. 08/446,051 filed May 19, 1995 (now U.S. Pat. No. 5,615,743).

BACKGROUND OF THE INVENTION

1. Field of the Invention

The present invention relates to a fire extinguisher, and more particularly, to a fire extinguisher which is simple in structure and easy to operate.

2. Description of the Related Art

A fire extinguisher having a cylinder filled with fire-extinguishing gas is constructed such that when a seal plate of the cylinder is manually or automatically broken at the outbreak of a fire, the fire-extinguishing gas is ejected from the cylinder to put out the fire. Many of conventional fire extinguishers contain component parts that are used in common in manual fire extinguishers and automatic fire extinguishers. Fire extinguishers of this type are, however, disadvantageous in that they are complicated in structure, require a large number of parts, and are costly. Further, some fire extinguishers require complicated handling or involve a difficulty in accurately aiming at the origin of a fire, which hinders fire-fighting work or lessens the fire-extinguishing capability.

Also known is a fire extinguisher having a replaceable cylinder. In this type of fire extinguisher, the component parts thereof must be reset in their initial state when the cylinder is replaced; this often makes it difficult to smoothly load a new cylinder. If the cylinder cannot be smoothly replaced, then it is difficult to perform fire-fighting work using a plurality of cylinders successively replaced.

SUMMARY OF THE INVENTION

It is an object of the present invention to provide a fire extinguisher which is simple in structure, easy to handle, and inexpensive.

It is another object of the present invention to provide a fire extinguisher which permits easy and prompt replacement of cylinders.

According to a first aspect of the present invention, a fire extinguisher comprises a hollow extinguisher body for containing a cylinder filled with fire-extinguishing gas, the extinguisher body including a nozzle having an extinguishing gas ejection hole formed therein in communication with a first extinguishing gas passage defined between the cylinder and the extinguisher body, and an opening formed in one end thereof remote from the nozzle; a hollow pusher guide member detachably mounted to the opening of the extinguisher body; a pusher axially movably arranged in an internal space of the pusher guide member and irremovable from the pusher guide member, the pusher having a groove formed in an outer peripheral surface thereof; a safety plate provided externally to the pusher guide member and detachably fitted into the groove of the pusher to thereby axially immovably fix the pusher; a needle attached to the pusher and having a striker pin for breaking a seal plate of the cylinder; a cylinder receiver mounted to the pusher guide member, the cylinder receiver detachably receiving the cylinder such that the seal plate of the cylinder faces the striker pin of the needle, the cylinder receiver and the needle having a second extinguishing gas passage formed therein in communication with the first extinguishing gas passage; and a spring interposed between the pusher and the cylinder receiver.

This fire extinguisher is advantageous in that an extinguishing person can easily start fire extinguishing work by grasping the extinguisher body with one hand, detaching the safety plate from the pusher with the other hand, and then striking the pusher to eject the fire-extinguishing gas. Also, this fire extinguisher requires a small number of component parts; therefore, it is simple in construction and inexpensive. Further, by removing the pusher guide member from the extinguisher body, it is possible to detach the pusher guide member, pusher, needle, cylinder receiver and cylinder from the extinguisher body. Accordingly, the cylinder of the fire extinguisher can be easily replaced with a new one by detaching the used cylinder from the cylinder receiver, attaching a new cylinder to the cylinder receiver, mounting the pusher guide member to the extinguisher body, and then fitting the safety plate in the groove of the pusher, without the need for a resetting operation which is indispensable in a conventional fire extinguisher.

According to a second aspect of the present invention, a fire extinguisher comprises a hollow extinguisher body surrounding a cylinder filled with fire-extinguishing gas, the extinguisher body defining a passage opening at a bottom side of the cylinder, in cooperation with the cylinder; a hollow cover fixed to the extinguisher body, the hollow cover having a striker pin facing a head of the cylinder for breaking a seal plate, an extinguishing gas ejection hole extending through the striker pin, and a plate insertion hole; a cylinder supporting member axially movably arranged within the hollow cover and supporting the head of the cylinder, the cylinder supporting member having a plate engaging section formed in an outer peripheral surface thereof in alignment with the plate insertion hole of the hollow cover; and a safety plate inserted through the plate insertion hole of the hollow cover for detachable engagement with the plate engaging section of the cylinder supporting member.

This fire extinguisher is advantageous in that fire extinguishing work can be easily performed by, with the fire extinguisher grasped, detaching the safety plate from the cylinder supporting member and then striking the bottom of the cylinder. Further, the extinguishing gas passage is formed by the ejection hole which extends through the striker pin of the hollow cover in the same direction as that of ejection of the fire-extinguishing gas from the cylinder. Accordingly, when compared with the fire extinguisher in which the extinguishing gas passage is formed between the extinguisher body and the cylinder, this fire extinguisher can prevent the ejection pressure of the fire-extinguishing gas from being lowered during the period from ejection of the gas from the cylinder to ejection of the gas to the outside of the fire extinguisher, and thus can prevent the fire extinguishing capability from lowering due to reduced ejection pressure. Also, since the extinguisher body need not be so constructed as to withstand high ejection pressure of fire-extinguishing gas, the component parts of the fire extinguisher other than the cylinder may be made of synthetic resin, thus reducing the manufacturing cost of the fire extinguisher. Accordingly, this fire extinguisher is suitable as a disposable fire extinguisher, and can also be reduced in weight. Further, since the passage is formed between the extinguisher body and the cylinder, the fingers grabbing the extinguisher body never get frostbitten due to the vaporization of liquefied gas serving as the fire-extinguishing gas.

According to a third aspect of the present invention, a fire extinguisher comprises a fixing member for supporting a cylinder filled with fire-extinguishing gas, the fixing member having a peripheral wall in which a cylinder mounting section for receiving a head of the cylinder, a stepped hole and an extinguishing gas ejection hole are formed; a needle supporting member axially movably arranged in the stepped hole and the cylinder mounting section of the fixing member, the needle supporting member including a collar arranged in the cylinder mounting section and having a larger diameter than the stepped hole, and a needle arranged on the collar so as to face a seal plate provided on the head of the cylinder for breaking the seal plate; a spring arranged in the stepped hole of the fixing member between a shoulder of the stepped hole and the collar of the needle supporting member for pressing the needle supporting member toward the cylinder; a spring cotter pin both compressible and expandable, the spring cotter pin serving to, when compressed, hold the needle supporting member in an initial position in which the needle is separated from the seal plate of the cylinder, against a force exerted by the spring; and a fusible cap fitted on the fixing member for holding the spring cotter pin in a compressed state, the spring cotter pin being allowed to expand when the fusible cap is heated and melted, thereby allowing axial movement of the needle supporting member, whereby the needle breaks the seal plate of the cylinder.

This fire extinguisher is advantageous in that, when the fusible cap is heated and melted at the outbreak of a fire, the spring cotter pin automatically expands and thus permits axial movement of the needle supporting member so that the seal plate of the cylinder is broken by the needle, whereby the fire-extinguishing gas is ejected from the cylinder through the ejection hole of the fixing member to automatically put out the fire. Since the ejection hole is formed in the peripheral wall of the fixing member which supports the cylinder head, the extinguisher body need not be constructed so as to withstand the ejection pressure of fire-extinguishing gas, unlike the fire extinguisher in which the extinguishing gas passage is formed between the extinguisher body and the cylinder. Further, this fire extinguisher requires a small number of component parts, and thus the manufacturing cost of the fire extinguisher can be reduced. Accordingly, this fire extinguisher is suitable as a disposable automatic fire extinguisher.

According to a fourth aspect of the present invention, a fire extinguisher comprises a barrel having an internal space for axially movably receiving a cylinder filled with fire-extinguishing gas, the barrel having a front wall in which a recess for detachably receiving a head of the cylinder, an extinguishing gas ejection hole communicating with the recess, and a striker pin for breaking a seal plate of the cylinder are formed, a rear wall, an upper wall in which a window permitting entry and removal of the cylinder is formed, a lower wall having an opening, and side walls having a first axial slot formed therein; a grip fixed to the lower wall of the barrel, the grip supporting a first pin located at a front portion thereof and second and third pins located close to the rear wall and the front wall, respectively, of the barrel with respect to the first pin, the grip being connected to one end of each of first and second expansion springs fitted round the first and second pins, respectively; a hammering section arranged in the internal space of the barrel so as to be axially movable between an inoperative position separate from a bottom of the cylinder and an operative position at which the hammering section strikes the bottom of the cylinder; a hammer operating section axially movably mounted on the barrel for moving the hammering section to the inoperative position thereof; an annular cylinder withdrawing section axially movably arranged in the internal space of the barrel and receiving the head of the cylinder therethrough; an arm axially movably arranged in the internal space of the barrel and coupled to the cylinder withdrawing section, the arm having a second slot formed in a half thereof close to the rear wall of the barrel; a connecting pin coupling the hammer operating section to the hammering section, the connecting pin being axially movable within the first slot of the side wall of the barrel and the second slot of the arm and capable of engaging with an end of the second slot close to the rear wall of the barrel; a hammer spring arranged in the internal space of the barrel between the hammering section and the rear wall of the barrel, for pressing the hammering section toward the operative position thereof; a trigger pivotally supported on the first pin, the trigger being pressed toward an inoperative position thereof by the first expansion spring to another end of which the trigger is connected, and having an extended part for projecting into the internal space of the barrel through the opening of the lower wall; a hammer stopper pivotally supported on the second pin for engaging with the hammering section to hold the hammering section in the inoperative position thereof, the hammer stopper being capable of projecting into the internal space of the barrel through the opening of the lower wall to be held in an operative position, in which the hammer stopper is engaged with the hammering section, by the second expansion spring to another end of which the hammer stopper is connected, the hammer stopper being turned as the trigger turns to the operative position thereof and brought to an inoperative position in which the hammer stopper is disengaged from the hammering section; and a cylinder force-out section pivotally supported on the third pin for pushing out a used cylinder, the cylinder force-out section being disposed for engagement with the extended part of the trigger, the cylinder force-out section being turned in a cylinder force-out direction by the extended part of the trigger and projecting into the internal space of the barrel through the opening of the lower wall as the trigger turns to the inoperative position thereof while the hammering section is in the inoperative position thereof.

This fire extinguisher is advantageous in that an extinguishing person can easily start fire extinguishing work by pressing the trigger of the fire extinguisher while holding the grip. Also, the fire extinguisher can be accurately aimed at the origin of a fire by pointing the front of the extinguisher to the fire; therefore, the fire-extinguishing gas is prevented from being ejected wastefully. The cylinder never jumps out of the fire extinguisher due to the reaction force of the ejected extinguishing gas, thus ensuring safety while the extinguisher is used. Further, insertion/detachment of a cylinder into/from the extinguisher barrel can be quickly and easily carried out, and therefore, fire extinguishing work can be continued by successively replacing a plurality of cylinders. According to a preferred embodiment in which a single cylinder is contained in the extinguisher barrel, the fire extinguisher is small in size, lightweight, and handy for fire extinguishing work.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
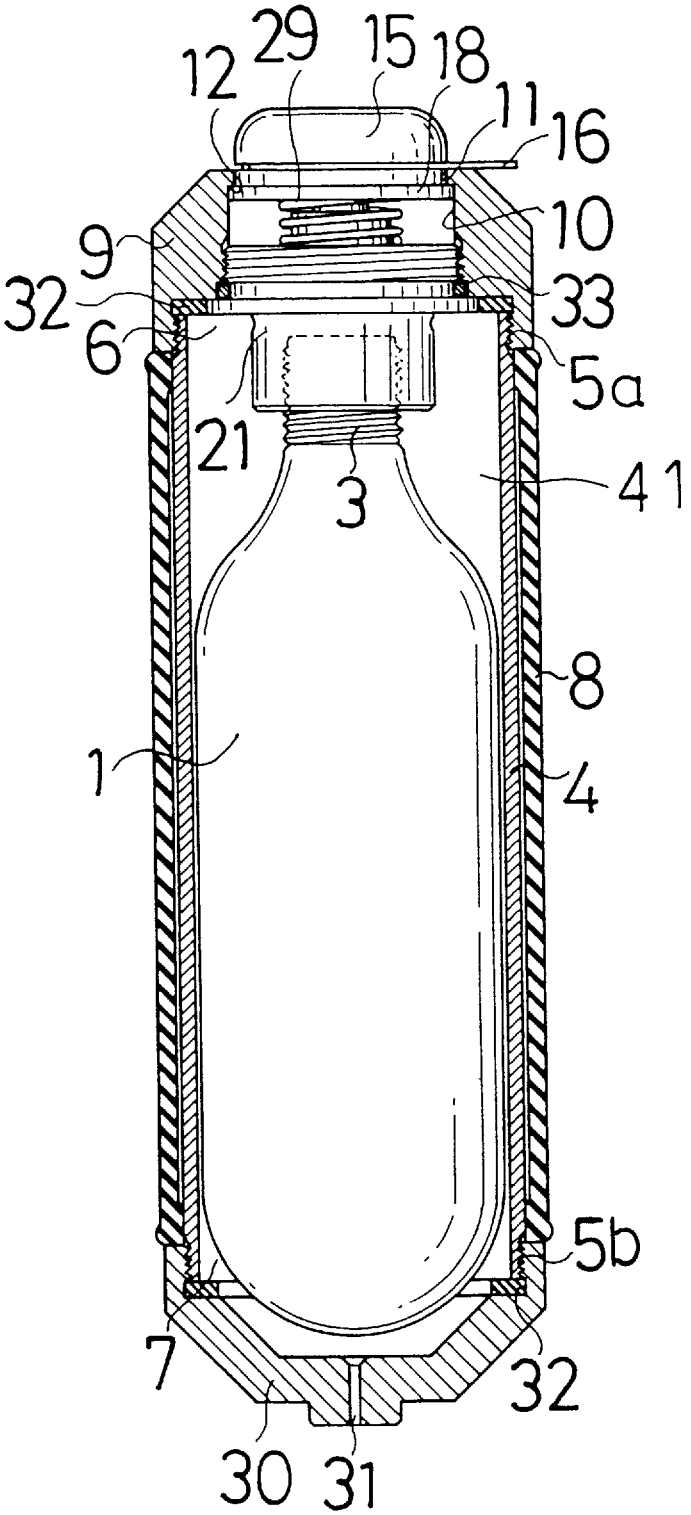
FIG. 1 is a longitudinal sectional view of a manual fire extinguisher according to a first embodiment of the present invention.
Figure 2:
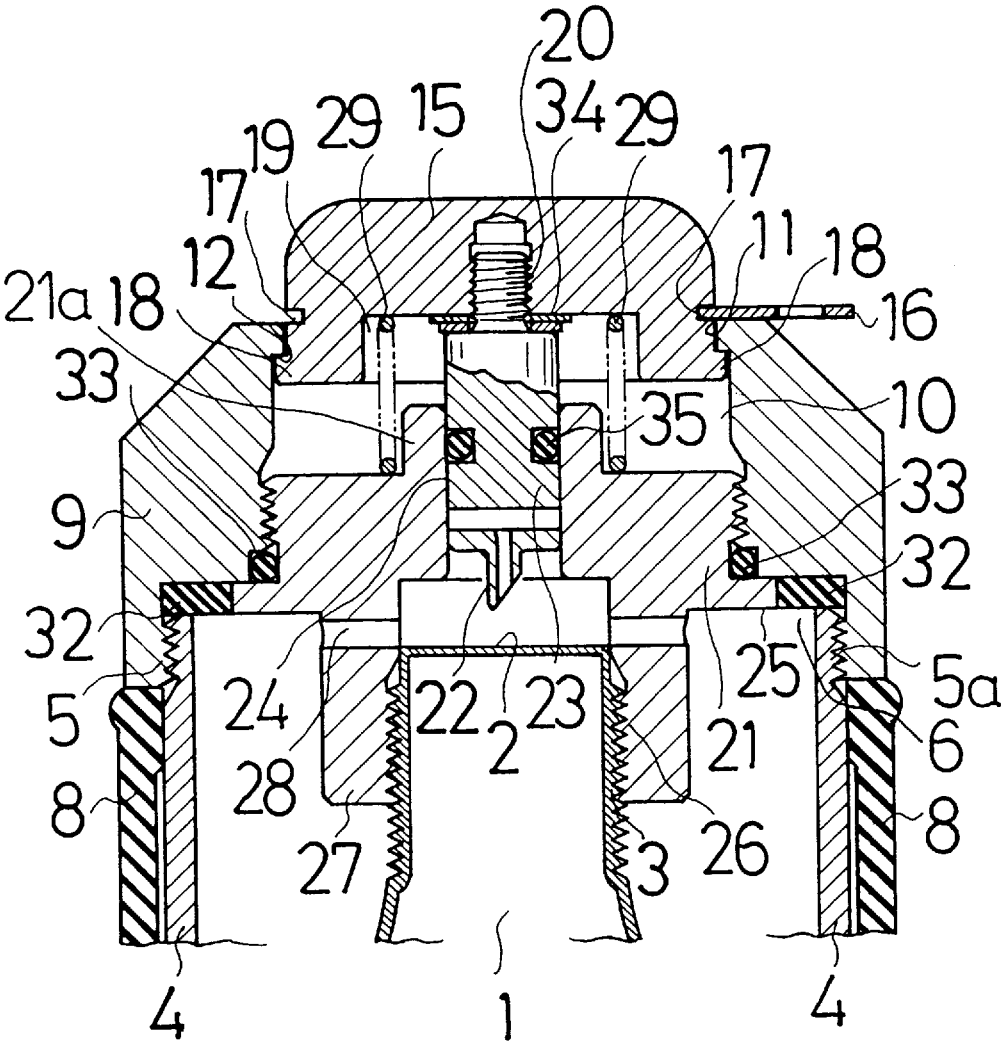
FIG. 2 is an enlarged longitudinal sectional view of a principal part of the fire extinguisher shown in FIG. 1.
Figure 3:
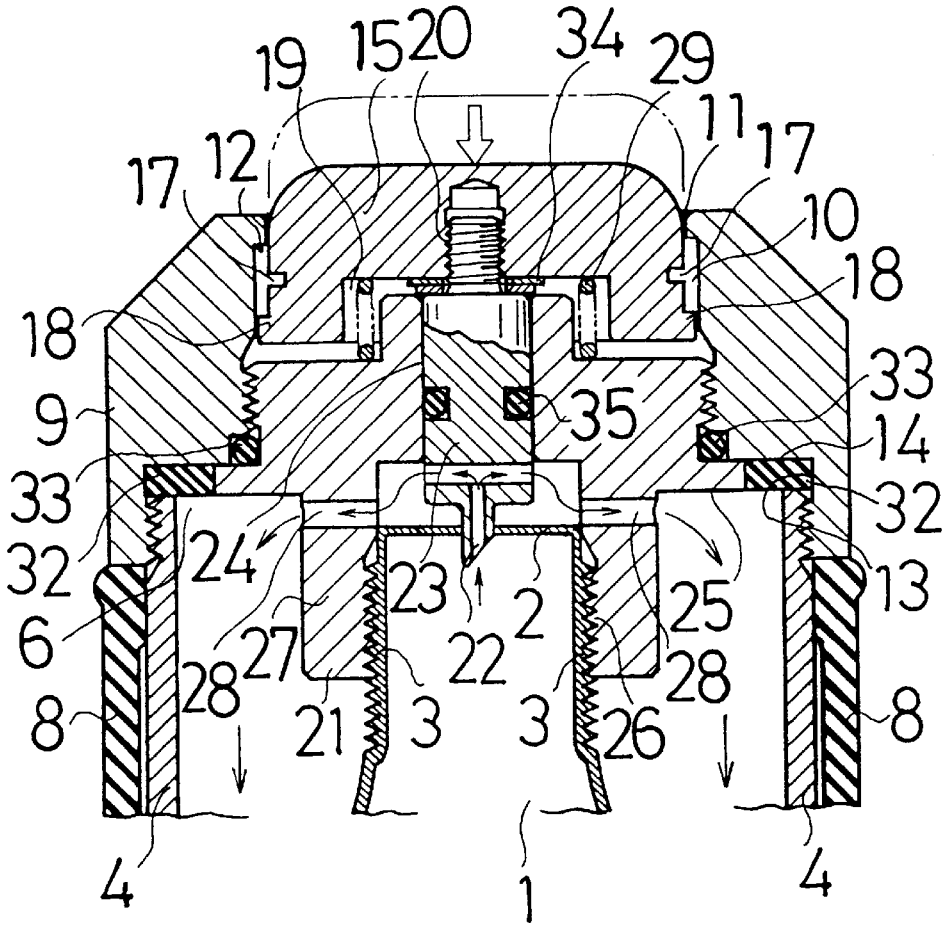
FIG. 3 is a view similar to FIG. 2, illustrating an operating state of the principal part of the fire extinguisher.

Referring first to FIGS. 1 through 3, a manual fire extinguisher according to a first embodiment of the present invention will be described.

The fire extinguisher comprises a hollow extinguisher body, which includes a pipe member 4 containing a substantially cylindrical member (hereinafter merely referred to as "cylinder") 1 filled with a fire-extinguishing gas, a cylindrical cover 8 fitted around the pipe member 4, and a dish-shaped nozzle 30 attached to a lower open end 7 of the pipe member 4. The nozzle 30 has a hole 31 formed therein for ejecting the fire-extinguishing gas therethrough, the hole 31 extending along the axis of the fire extinguisher.

Threads 5*a* and 5*b* are cut in the outer peripheral surfaces of upper and lower open end portions 6 and 7 of the pipe member 4, respectively. Also, a thread is cut in the inner peripheral surface of the peripheral wall of the nozzle 30 so as to be engaged with the thread 5*b* of the pipe member 4. Thus, the nozzle 30 is screwed onto the pipe member 4 and closes the lower open end 7 of the same. The cylinder 1 is surrounded by the pipe member 4 and the nozzle 30, and a first extinguishing gas passage 41 communicating with the ejection hole 31 of the nozzle 30 is defined between the cylinder 1 and the pipe member 4 and between the cylinder 1 and the nozzle 30.

The fire extinguisher further includes a hollow cylindrical pusher guide member 9. An upper half of the pusher guide member 9 has an upper open end 11 and an axial hole 10 having a larger diameter than the open end 11, with an upper shoulder 12 located between the elements 10 and 11. A lower half of the pusher guide member 9 has an axial hole 13 having a larger diameter than the axial hole 10. A thread is cut in the inner peripheral surface of the axial hole 13 for engagement with the thread 5*a* of the pipe member 4. Thus, the pusher guide member 9 is detachably fitted (screwed) onto the upper open end portion 6 of the pipe member 4. The pusher guide member 9 has a lower shoulder 14 located between the axial holes 10 and 13.

In the axial hole 10 of the pusher guide member 9 is fitted a pusher 15 having a collar 18 at a lower end thereof. A spring 29 is interposed between the pusher 15 and a cylinder receiver 21 screwed into the pusher guide member 9, such that the spring 29 is loosely fitted around a boss 21*a* of the cylinder receiver 21. The upper end of the spring 29 rests on the bottom surface of a recess 19 formed in the bottom of the pusher 15, whereas the lower end of the spring 29 rests on an upper surface of the cylinder receiver 21. Except for the collar 18, the pusher 15 has a diameter slightly smaller than that of the upper open end 11 of the pusher guide member 9, and the diameter of the collar 18 is set to a value slightly smaller than that of the axial hole 10 of the pusher guide member 9 and at the same time larger than that of the upper open end 11 of the same. Namely, the pusher 15 cannot be detached from the upper open end portion 11 of the pusher guide member 9 but is allowed to axially move within the axial hole 10 of the guide member 9.

A groove 17 is cut in the outer peripheral surface of the pusher 15, and a safety plate 16 is detachably fitted in the groove 17 so as to be in contact with the upper surface of the pusher guide member 9. Accordingly, the pusher 15 is fixed in position and axial movement thereof is inhibited.

The pusher 15 further has a threaded blind hole 20 extending along the axis thereof, and an upper threaded portion of a cylindrical needle 23 is screwed into the blind hole 20 so that the needle 23 may be movable together with the pusher 15. The needle 23 is fitted through an axial hole 24 of the cylinder receiver 21, and has a striker pin 22 at a lower end thereof for breaking a seal plate 2 of the cylinder 1. The needle 23 has an axial hole formed through the striker pin 22 and a diametrical hole communicating with the axial hole.

The cylinder receiver 21 has an upper end portion in the outer peripheral surface of which a thread is cut so as to be engaged with a thread formed in the inner peripheral surface of an intermediate portion of the pusher guide member 9, a flange abutted against the lower shoulder 14 of the pusher guide member 9, and a hollow cylinder-shaped cylinder mounting section 27 to which the cylinder 1 is detachably mounted.

The aforementioned axial hole 24 is formed through the upper end portion of the cylinder receiver 21, and the cylinder mounting section 27 has ejection holes 28 extending in the diametrical direction thereof. The ejection holes 28 are disposed for communication with the axial hole of the needle 23 through the internal space of the section 27 and the diametrical hole of the needle 23. The ejection holes 28, the internal space of the cylinder mounting section 27, and the diametrical and axial holes of the needle 23 constitute a second extinguishing gas passage communicating with the first extinguishing gas passage. The cylinder mounting section 27 has a threaded portion 26 formed on an inner peripheral surface thereof for engagement with a thread formed on a head 3 of the cylinder 1. The cylinder 1 is screwed into the cylinder receiver 21 such that the seal plate 2 thereof faces the striker pin 22 of the needle 23.

The cylinder 1 is filled with about 60 cc of carbon dioxide- or nitrogen-containing liquefied gas as a fire-extinguishing gas. The liquefied gas, when vaporized, cools the surrounding area to a very low temperature of −30° C. to −40° C. and the volume thereof expands to about 500 times that in the liquefied state, thereby producing an oxygen deficient atmosphere. To effectively extinguish a fire, the proportion of oxygen to the air in a room should desirably be reduced from a normal percentage of 21% to about 15%. To this end, it is preferable that a required number of fire extinguishers calculated based on the volume of the room and the volume of the vaporized gas should be provided.

In FIGS. 1 to 3, reference numeral 32 represents packing members interposed between the upper end face of the pipe member 4 and the opposing face of the member 9 and between the lower end face of the member 4 and the opposing face of the nozzle 30, respectively, and 33 denotes a packing member interposed between the opposing peripheral surfaces of the pusher guide member 9 and the cylinder receiver 21. Reference numeral 34 denotes a washer arranged between the pusher 15 and the needle 23, and 35 denotes an O ring interposed between the opposing peripheral surfaces of the cylinder receiver 21 and the needle 23.

The operation of the manual fire extinguisher constructed as described above will be now explained.

This fire extinguisher is installed in case of the outbreak of a fire in a computer room, engine room, ship, automotive engine compartment, power distribution room, power supply compartment, boiler room, container of flammable materials, automatic power generator room, heating equipment room, storage of important articles, book room, storage of art objects, heat-generating electric appliance, cabinet of gas equipment, etc.

Figure 4:
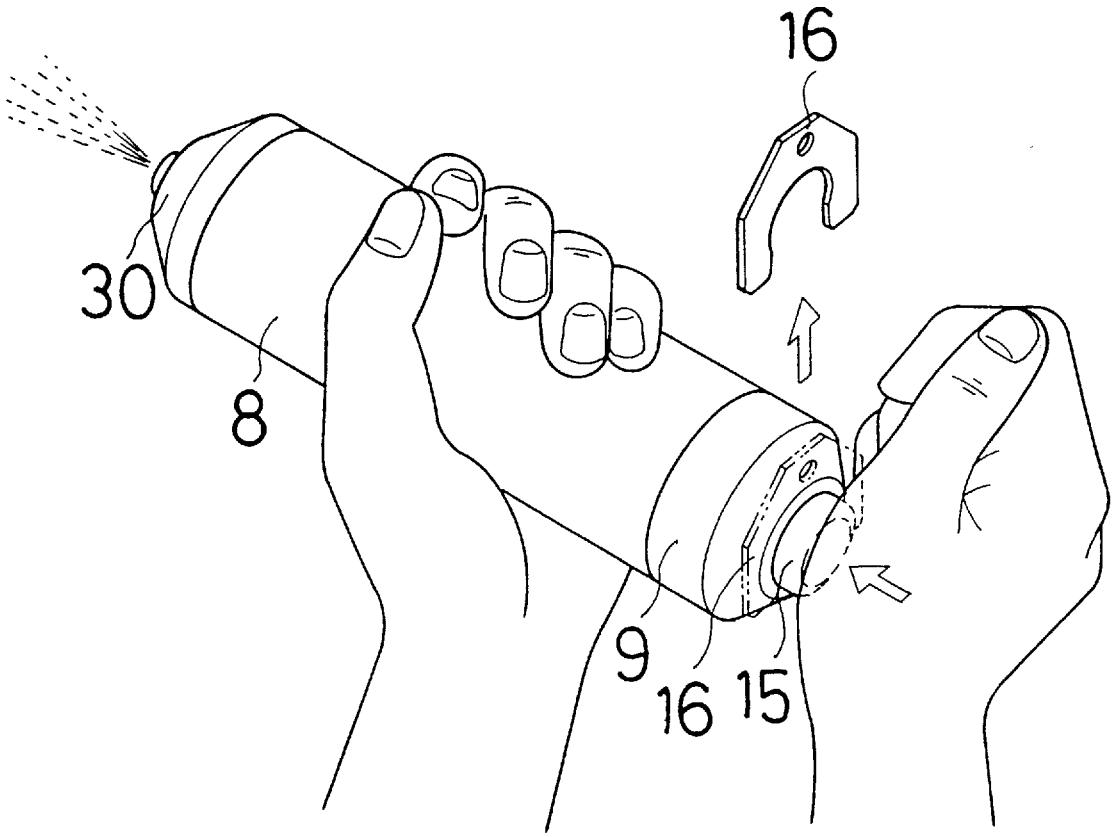
FIG. 4 is a perspective view illustrating how the fire extinguisher shown in FIGS. 1 through 3 is used.

In the event a fire breaks out, an extinguishing person holds the fire extinguisher with one hand and pulls off the safety plate 16 from the fire extinguisher with the other hand, as shown in FIG. 4, whereby the pusher 15 is allowed to move within the axial hole 10 of the pusher guide member 9. At this time, the pusher 15 is pressed upward as viewed in FIG. 1, due to the force of the spring 29 interposed between the pusher 15 and the cylinder receiver 21, but since the pusher 15 is in its initial position with the collar 18 thereof engaged with the upper shoulder 12 of the pusher guide member 9, the pusher 15 never becomes detached from the guide member 9.

Then, with the ejection hole 31 of the nozzle 30 aimed at the source of fire, the head of the pusher 15 is struck with the palm of the hand, whereupon the pusher 15 descends within the axial hole 10 while compressing the spring 29, as shown in FIG. 3. In this case, since the upper end of the spring 29 is received in the recess 17 of the pusher 15 and the lower end of the same is fitted around the boss 21*a* of the cylinder receiver 21, the spring 29 is not displaced sideways.

As the pusher 15 descends, the needle 23, which is formed integrally with the pusher 15, also descends within the axial hole 24, and the seal plate 2 of the cylinder 1 is broken by the striker pin 22 of the needle 23. As a result, the liquefied gas in the cylinder 1 flows into and fills the first extinguishing gas passage 41 defined by the cylinder 1, the pipe member 4 and the nozzle 30, through the second extinguishing gas passage (the axial and diametrical holes of the needle 23 and the internal space and ejection holes 28 of the cylinder mounting section 27 of the cylinder receiver 21), as shown in FIG. 3. The liquefied gas in the first passage 41 is then forcibly ejected from the ejection hole 31 of the nozzle 30 toward the source of fire. The liquefied gas thus ejected can directly reach the source of fire if the distance to the source of fire is 2.5 m or less, though the distance of ejection depends upon the quantity of the liquefied gas filled in the cylinder 1. Ejection of the liquefied gas from the fire extinguisher continues as long as the pusher 15 is depressed by the extinguishing person.

As the liquefied gas thus ejected from the fire extinguisher toward the source of fire vaporizes, the source of fire is cooled to an extremely low temperature of −30° C. to −40° C. and at the same time is smothered with a large quantity of vaporized gas, whereby oxygen becomes deficient and the source of fire extinguished. Since a liquefied gas is used to extinguish fire, various facilities, important articles or documents in the room do not get wet.

After the fire has been extinguished or when the cylinder 1 becomes empty during fire extinguishing work, the extinguishing person releases his or her hand from the pusher 15. Consequently, the pusher 15, which is released from the depressing force, rises to the initial position due to the force of the spring 29, whereby the operating parts of the fire extinguisher are automatically reset.

In the case where the fire extinguishing work is continued after the cylinder 1 becomes empty, the cylinder is replaced with a new one. To replace cylinders, after the operating parts of the fire extinguisher are reset, the extinguishing person removes the pusher guide member 9 from the pipe member 4, whereby the pusher guide member 9, as well as the pusher 15, the needle 23, the cylinder receiver 21 and the cylinder 1, are detached from the extinguisher body. Subsequently, the used cylinder 1 is removed from the cylinder receiver 21, and a new cylinder 1 is screwed into the cylinder receiver 21. The pusher guide member 9 is then screwed onto the pipe member 4, thereby attaching the pusher guide member 9, along with the pusher 15, the needle 23, the cylinder receiver 21 and the cylinder 1, to the extinguisher body. In this manner, the cylinder replacement is completed, and the extinguishing person again depresses the pusher 15, with the nozzle 30 aimed at the source of fire, to resume the fire extinguishing work.

In the fire extinguisher of this embodiment, the cylinder replacement can be reliably and easily carried out without the need for a special resetting operation of the operating parts of the fire extinguisher, whereby fire extinguishing work can be effectively performed by successively using a plurality of cylinders 1.

After the fire is extinguished, the extinguishing person replaces the cylinder with a new one if necessary, and then fits the safety plate 16 in the groove 17 of the pusher 15 so that the fire extinguisher may be ready for future use.

A manual fire extinguisher according to a second embodiment of the present invention will be now described.

The fire extinguisher of this embodiment is simpler in construction and less expensive, compared with the first embodiment, and thus is suitable as a disposable manual fire extinguisher.

Figure 5:
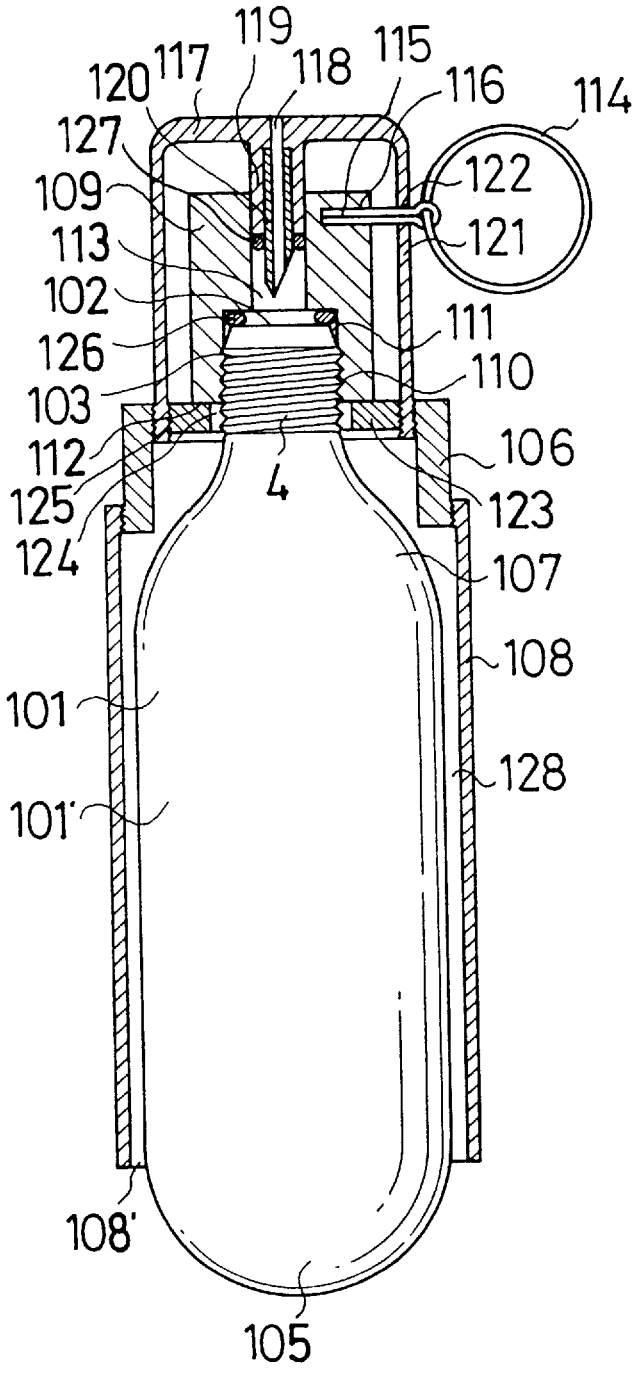
FIG. 5 is a longitudinal sectional view of a manual fire extinguisher according to a second embodiment of the present invention.

As shown in FIG. 5, the fire extinguisher of this embodiment comprises a cylinder 101 equivalent to the cylinder 1 in FIG. 1, a hollow cylindrical extinguisher body surrounding a shoulder 107 and body 101' of the cylinder 101, and a hollow cylindrical upper cover 117 secured to the extinguisher body, and a cylindrical support 109 for supporting a head 104 of the cylinder 101 is arranged in the internal space of the cover 117. The extinguisher body has an annular inner fixing section 123, an outer fixing section 106 having a hollow cylindrical shape, and a lower cover 108 having a hollow cylindrical shape and opening at a lower end 108' thereof. Preferably, the extinguisher body, the cover 117, and the cylinder support 109 are made of synthetic resin.

The inner fixing section 123 of the extinguisher body has a hole 124 formed therein through which the head 104 of the cylinder 101 is loosely inserted, and a thread 125 is cut in the outer peripheral surface of the fixing section 123. Also, a thread is formed in the inner peripheral surface of a lower end portion of the upper cover 117 for engagement with the thread 125, and the cover 117 is firmly screwed onto the inner fixing section 123. Further, a thread is cut in each of the outer peripheral surface of the lower end portion of the upper cover 117 and the inner peripheral surface of an upper end portion of the outer fixing section 106, and the outer fixing section 106 is firmly screwed onto the upper cover 117. The outer fixing section 106 surrounds part of the cylinder head 104 and the cylinder shoulder 107. A thread is formed in each of the outer peripheral surface of a lower end portion of the outer fixing section 106 and the inner peripheral surface of an upper end portion of the lower cover 108, and the lower cover 108 is firmly screwed onto the outer fixing section 106. The lower cover 108 surrounds the cylinder body 101'. The inner fixing section 123, the outer fixing section 106 and the lower cover 108 define a passage 128 opening at a bottom 105 of the cylinder, in cooperation with the cylinder 101.

The upper cover 117 has a hollow cylindrical protuberance 119 extending from a top wall thereof toward a seal plate 102 of the cylinder 110 along the axis thereof, and a striker pin 120 for breaking the seal plate 102 is securely fitted into the opening of the protuberance 119. The protuberance 119 and the striker pin 120 define an ejection hole 118 extending therethrough in the axial direction thereof.

The cylinder support 109, which is arranged inside the upper cover 117, has an axial large-diameter hole 111 and an axial small-diameter hole 113 continuous with the hole 111. An internal thread 110 is cut in a lower part of the inner peripheral surface of the peripheral wall of the cylinder support 109 for engagement with a thread 103 formed on the outer peripheral surface of the cylinder head 104, and the cylinder 101 is screwed into the cylinder support 109. The protuberance 119 of the upper cover 117 and the striker pin 120 are inserted into the small-diameter hole 113 of the cylinder support 109, and the cylinder support 109 is axially movable along the protuberance 119.

A plate insertion hole 122 is cut in the peripheral wall of the upper cover 117, and a plate engaging recess 116 extending substantially perpendicular to the axis of the fire extinguisher is formed in the outer peripheral surface of the cylinder support 109 in alignment with the insertion hole 122. Reference numeral 114 denotes a safety plate inserted through the insertion hole 122 of the upper cover 117. When a leg 115 of the plate 114 is engaged with the recess 116 of the cylinder support 109, the cylinder support 109 is fixed at an initial position where a bottom surface 112 thereof is in contact with the inner fixing section 123 and axial movement-thereof is inhibited.

Reference numeral 126 represents an O ring interposed between the opposing faces of the seal plate 102 of the cylinder 101 and the cylinder support 109, and 127 represents an O ring fitted around the striker pin 120.

The fire extinguisher of this embodiment is assembled as follows:

First, the threaded cylinder head 104, around which the inner fixing section 123 is loosely fitted, is screwed into the threaded hole 110 of the cylinder support 109 into which the O ring 126 has already been fitted, to securely fix the cylinder 101 to the cylinder support 109. Subsequently, with the protuberance 119 of the upper cover 117, around which the O ring 127 is fitted, inserted into the small-diameter hole 113 of the cylinder support 109, the upper cover 117 is screwed onto the inner fixing section 123. Next, the leg 115 of the safety plate 114 is inserted through the insertion hole 122 of the upper cover 117 into the recess 116 of the cylinder support 109, thereby fixing the cylinder support 109 in the initial position. Then, the outer fixing section 106 is screwed onto the upper cover 117, and the lower cover 108 is screwed onto the outer fixing section 106, thus completing the assembling of the fire extinguisher.

The operation of the fire extinguisher according to this embodiment will be now explained. This fire extinguisher is installed in case of the outbreak of a fire in a computer room etc., like the fire extinguisher of the first embodiment. In the event a fire breaks out, an extinguishing person holds the lower cover 108 of the fire extinguisher with one hand and pulls off the safety plate 114 from the fire extinguisher with the other hand, whereby the cylinder support 109 and the cylinder 101 attached thereto are allowed to move.

Then, with the ejection hole 118 of the fire extinguisher aimed at the source of fire, the bottom 105 of the cylinder is struck with the palm of the hand, whereupon the cylinder support 109 moves along the protuberance 119 of the upper cover 117 toward the protuberance 119. Simultaneously, the cylinder 101 moves in the same direction, and the seal plate 102 of the cylinder 101 is broken by the striker pin 120 fixed to the protuberance 119. As a result, the liquefied gas in the cylinder 101 is forcibly ejected from the ejection hole 118 formed through the protuberance 119 and the striker pin 120, toward the source of fire. The liquefied gas thus ejected can directly reach the source of fire if the distance to the source of fire is 2 m or less, though the distance of ejection depends upon the quantity of the liquefied gas filled in the cylinder 101.

As the liquefied gas thus ejected from the fire extinguisher toward the source of fire vaporizes, the source of fire is cooled to an extremely low temperature of −30° C. to −40° C. and at the same time is smothered with a large quantity of vaporized gas, whereby oxygen becomes deficient and the source of fire extinguished.

In the fire extinguisher of this embodiment, the direction of ejection of the liquefied gas from the fire extinguisher is identical with that of the liquefied gas ejected from the cylinder 101, and thus the ejection pressure of the liquefied gas is not lowered. Accordingly, the fire extinguisher of this embodiment has excellent fire-extinguishing capability. Although a part surrounding the protuberance 119 through which the ejection hole 118 is formed may be cooled to a very low temperature due to the ejection of the liquefied gas from the cylinder 101, the lower cover 108 is in no way cooled to such low temperature. The reason is that no liquefied gas flows into the passage 128 defined between the cylinder 101 and the lower cover 108, that the lower cover 108 is prevented from being cooled to very low temperature because of free circulation of air between the passage 128 and the outside of the fire extinguisher through the open end 108' of the passage 128, and that the lower cover 108 is prevented from being cooled to very low temperature because the protuberance 119, the lower cover 108 and the component parts of the extinguisher connecting these elements are made of synthetic resin which has low thermal conductivity. Since the lower cover 108 is not cooled to very low temperature, it is possible to prevent the hands or fingers of the extinguishing person holding the fire extinguisher from becoming frostbitten, thus ensuring safety of the fire extinguisher when in use.

A manual fire extinguisher according to a third embodiment of the present invention will be described.

The fire extinguisher of this embodiment is simpler in construction and less expensive, compared with that of the first embodiment, is designed to automatically eject a fire-extinguishing gas at the outbreak of a fire, and is suitable as a disposable automatic fire extinguisher.

Figure 6:
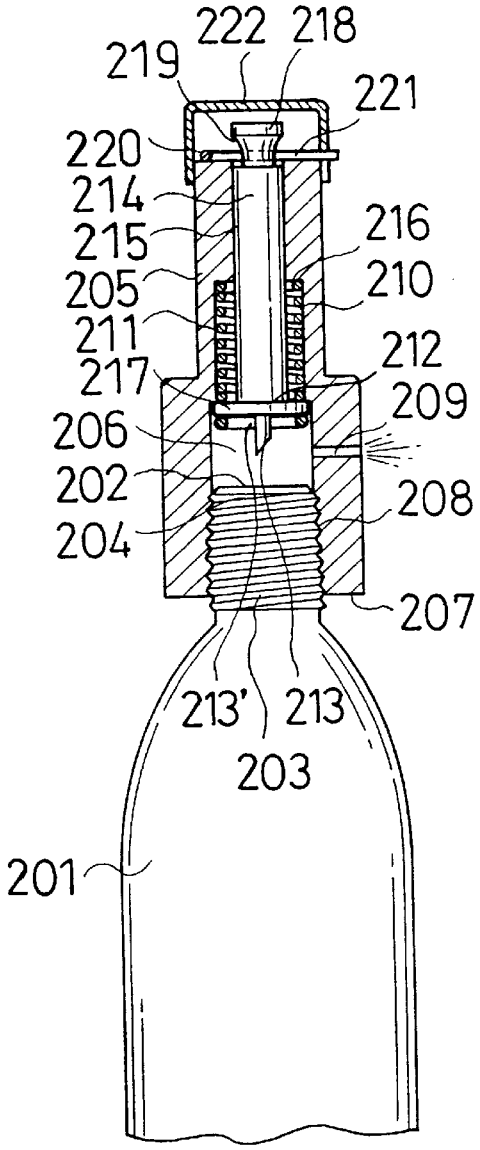
FIG. 6 is a longitudinal sectional view of part of an automatic fire extinguisher according to a third embodiment of the present invention.
Figure 7:
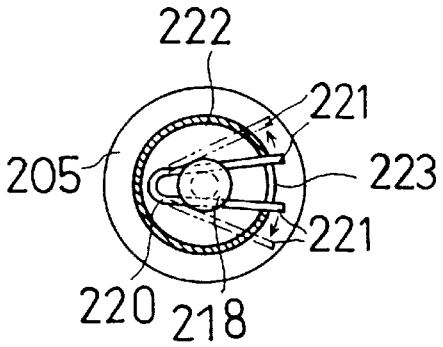
FIG. 7 is a top view showing, partly in section, a fixing member of the fire extinguisher of FIG. 6, together with peripheral parts thereof.

As shown in FIGS. 6 and 7, the fire extinguisher of this embodiment comprises a cylinder 201 corresponding to the cylinder 1 in FIG. 1, and a fixing member 205 supporting the cylinder. A lower half of the fixing member 205 is formed as a large-diameter cylinder through which an axial hole (hereinafter referred to as "lower axial hole") 216 is formed, and an extinguishing gas ejection hole 209 is formed through the peripheral wall of the lower half perpendicularly to the axis of the fixing member 205. Although the fixing member 205 shown in FIG. 6 has only one ejection hole 209, a plurality of ejection holes may be formed through the peripheral wall of the fixing member 205.

The peripheral wall of the lower half of the fixing member 205 defines therein a cylinder mounting section 206 into which a head 204 of the cylinder is fitted, and an internal thread 208 is cut in the inner peripheral surface of the peripheral wall. A thread 203 is formed on the outer peripheral surface of the cylinder head 204 for engagement with the internal thread 208, and thus the cylinder 201 is screwed into the fixing member 205.

An upper half of the fixing member 205 is formed as a cylinder having a smaller diameter than the lower half, and a stepped axial hole (hereinafter referred to as "upper axial hole") 215 having a smaller diameter than the lower axial hole 216 is formed through the upper half in communication with the lower axial hole 216.

A needle supporting member 214 is axially movably arranged in the upper and lower axial holes 215 and 216 of the fixing member 205. At a lower end portion of the supporting member 214 are formed a collar 217 having a diameter larger than that of the upper axial hole 215 and slightly smaller than that of the lower axial hole 216 and slidable within the lower axial hole 216, and a needle 213 for breaking a seal member 202 affixed to the cylinder head 204. The needle 213 extends toward the seal member 202 along the axis of the needle supporting member 214. A spring 211 is fitted around a portion of the needle supporting member 214 located in the upper axial hole 215 and pushes the supporting member 214 toward the cylinder 201. The upper and lower ends of the spring 211 rest on a shoulder 216 formed on the inner peripheral surface of the peripheral wall of the fixing member 205 and the collar 217 of the needle supporting member 214, respectively.

When the needle supporting member 214 is in its initial position (inoperative position), a head 218 thereof projects from the fixing member 205 to the outside, and a recess 219 is formed in the head 218. Reference numeral 220 denotes a spring cotter pin both compressible and expandable, and 222 denotes a fusible cap made of a material which is melted when heated to a fixed temperature, for example, 70° C. The fusible cap 222 serves to retain the spring cotter pin 220 in a compressed state until the fixed temperature is reached. The fusible cap 222 is secured to the outer peripheral surface of an upper portion of the fixing member 205 and surrounds the head 218 of the needle supporting member 214.

As shown in FIG. 7, the spring cotter pin 220 is U-shaped when viewed in plan, and the ends of two legs 221 of the spring cotter pin 220 project to the outside of the fusible cap 222 through an indentation 223 cut in the peripheral wall of the cap 222. The two legs 221 are pressed against corresponding edges of the indentation 223, whereby the spring cotter pin 220 is held in a compressed state in which it engages with the recess 219 of the needle supporting member 214. While in the compressed state, the spring cotter pin 220 retains the needle supporting member 214 in its initial position at which the needle 213 is separated from the seal plate 202 of the cylinder 201, against the force of the spring 211.

The operation of the automatic fire extinguisher described above will be now explained.

This fire extinguisher is installed in case of the outbreak of a fire in a computer room etc., like those of the first and second embodiments. At the outbreak of a fire, when the fusible cap 222 is heated with increase in the room temperature up to the fixed temperature of, for example, 70° C., and thus is melted, the spring cotter pin 220 is released from the constraint of the fusible cap 222; accordingly, the pin 220 expands by its own elastic force, as indicated by the two-dot-chain lines in FIG. 7, and is disengaged from the recess 219 of the needle supporting member 214. As a result, the needle supporting member 214 is allowed to move in the axial direction. The needle supporting member 214 is always pressed toward the cylinder 201 by the force of the spring 211; therefore, the needle supporting member 214 axially moves toward the cylinder 201 and the needle 213 breaks the seal plate 202.

Consequently, the liquefied gas in the cylinder 201 fills in the cylinder mounting section 206 and then is forcibly ejected through the ejection hole 209 of the fixing member 205. The distance of ejection of the liquefied gas from the fire extinguisher is about 2 m, though it depends upon the quantity of the liquefied gas filled in the cylinder 201. As the liquefied gas thus ejected from the fire extinguisher vaporizes, objects surrounding the fire-extinguishing gas are cooled to an extremely low temperature of −30° C. to −40° C., and also a large quantity of vaporized gas fills in the room, thus creating an oxygen deficient environment, whereby fire is extinguished.

In the fire extinguisher of this embodiment, the fire-extinguishing gas is automatically ejected from the cylinder at the outbreak of a fire, thus permitting automatic fire extinction. Since this fire extinguisher requires a small number of parts and is easy to assemble, it is suitable as a very economical, disposable automatic fire extinguisher.

Figure 8:
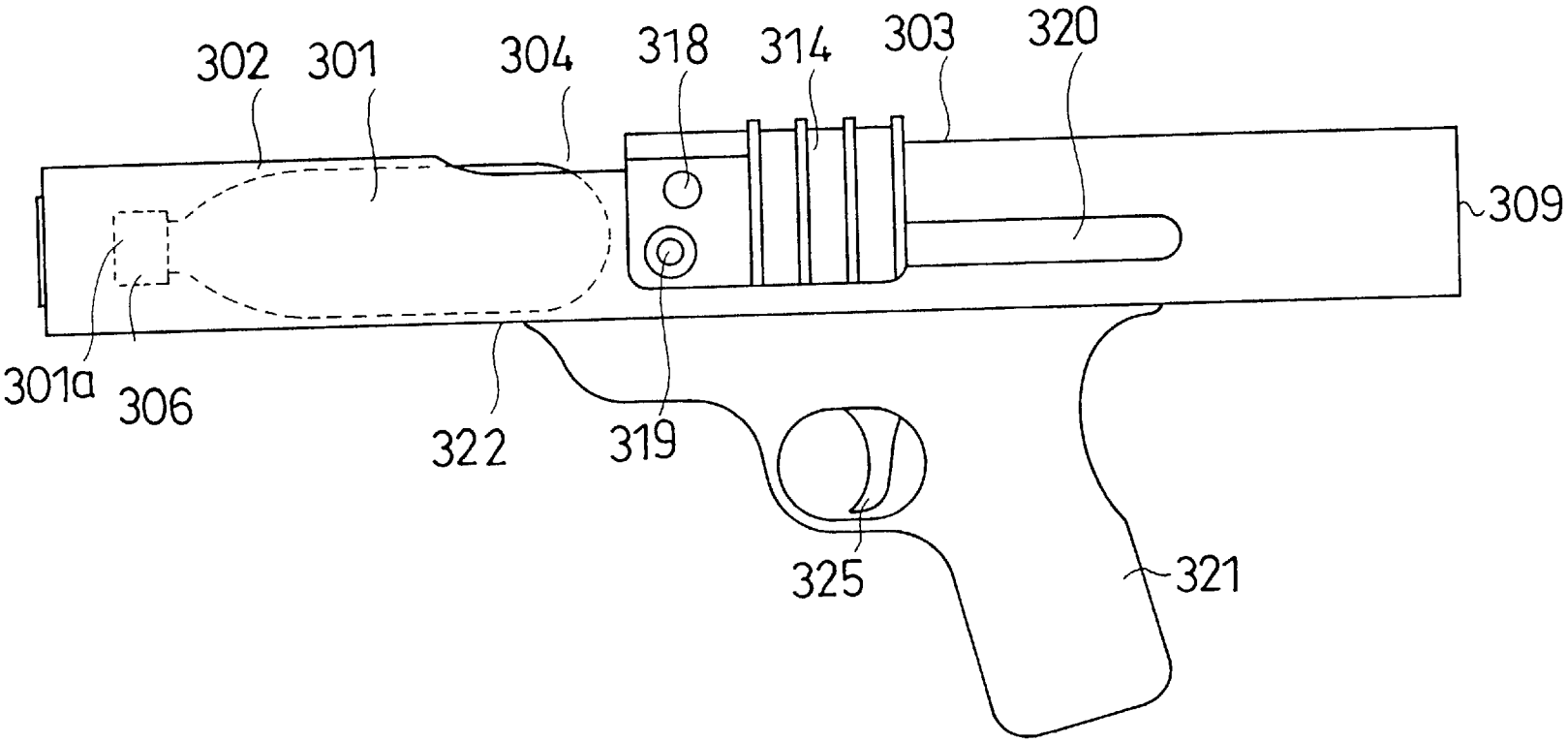
FIG. 8 is a front view of a gun-type fire extinguisher according to a fourth embodiment of the present invention.
Figure 9:
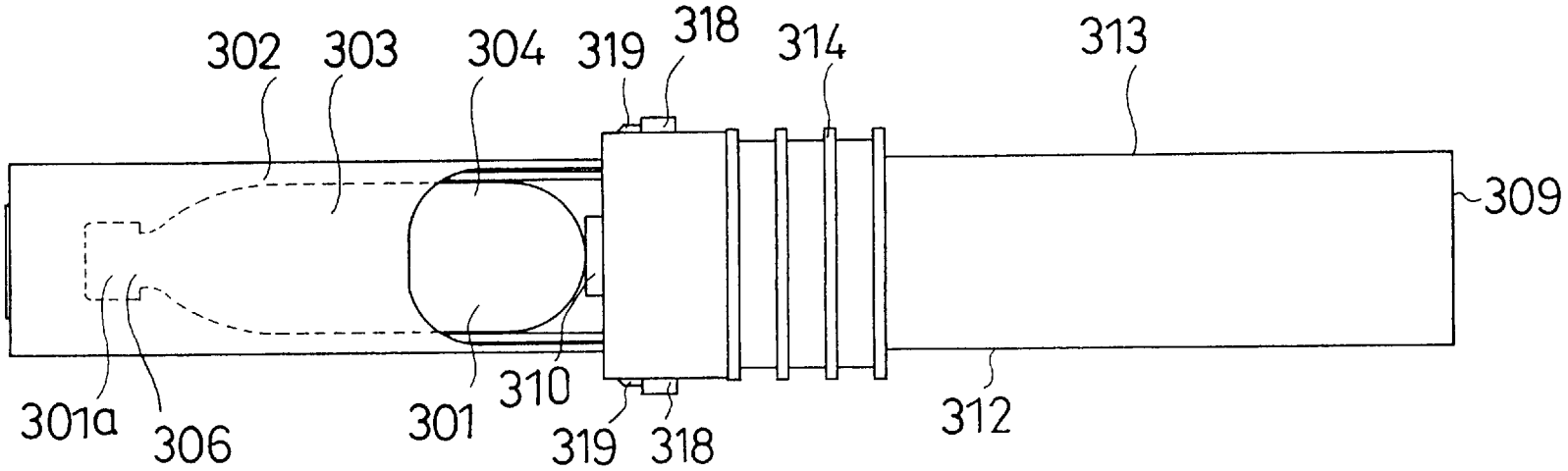
FIG. 9 is a plan view of the fire extinguisher shown in FIG. 8.

Referring now to FIGS. 8 though 16, a gun-type fire extinguisher according to a fourth embodiment of the present invention will be described.

Figure 11:
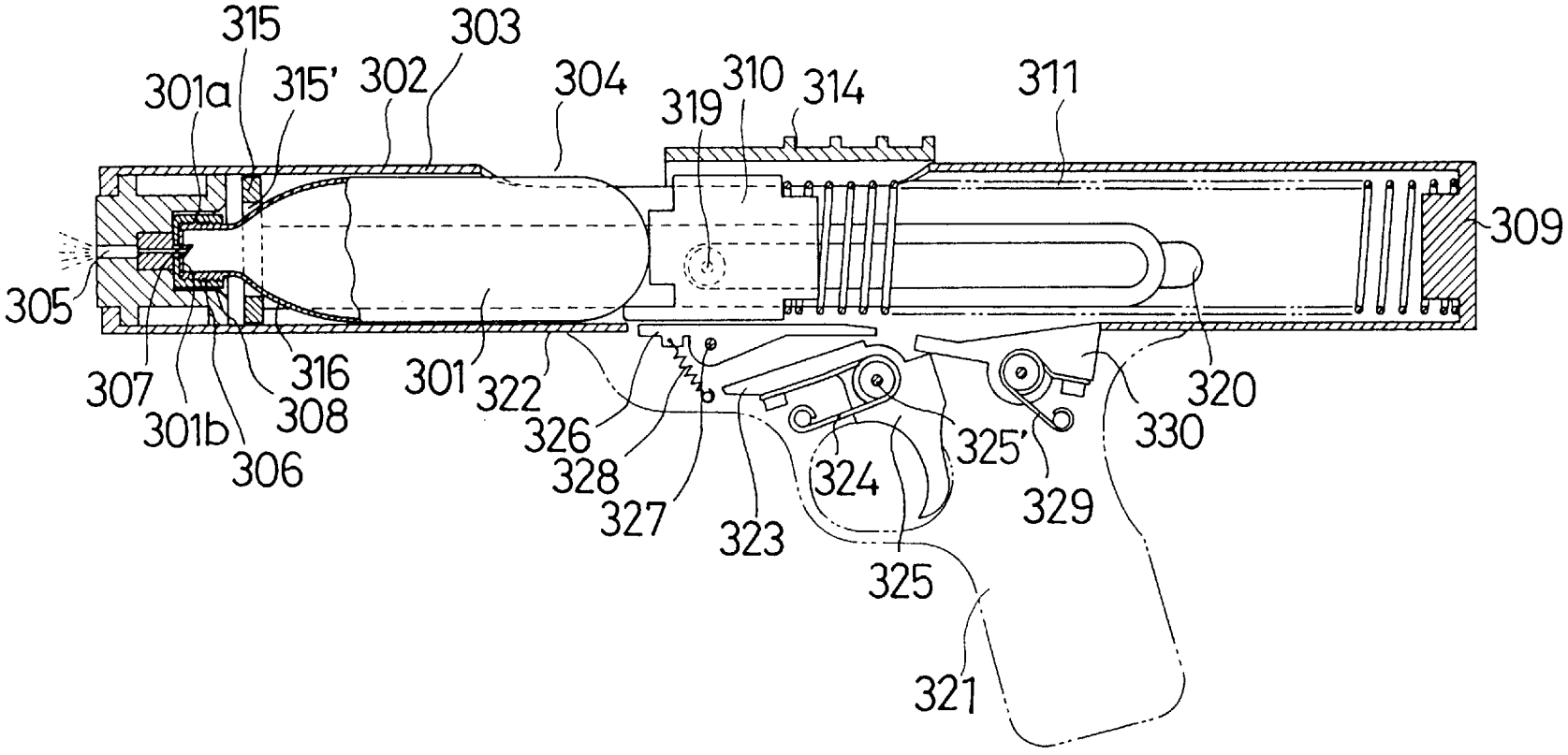
FIG. 11 is a front sectional view of the fire extinguisher from which fire-extinguishing gas is ejected.

This fire extinguisher comprises a barrel 302 having an internal space for receiving a cylinder 301 filled with fire-extinguishing gas, and a window 304 is formed in an upper wall 303 of the barrel 302 for allowing entry and removal of the cylinder 301. As shown in FIG. 11, an extinguishing gas ejection hole 305 and a recess 308 communicating therewith are formed in the front wall of the barrel 302, and the head of the cylinder 301 is detachably fitted into the recess 308. Reference numeral 301*a* represents a packing member capped on the cylinder head. A striker pin 307 for breaking a seal plate 301*b* of the cylinder 301 protrudes from the recess 308.

The barrel 302 further has a rear wall 309, a lower wall 322 to which a grip 321 is fixed, and side walls 312 and 313

(FIG. 16) in each of which an axial slot 320 is formed, and the upper and lower walls, front and rear walls, and side walls of the barrel 302 define the internal space.

Figure 16:
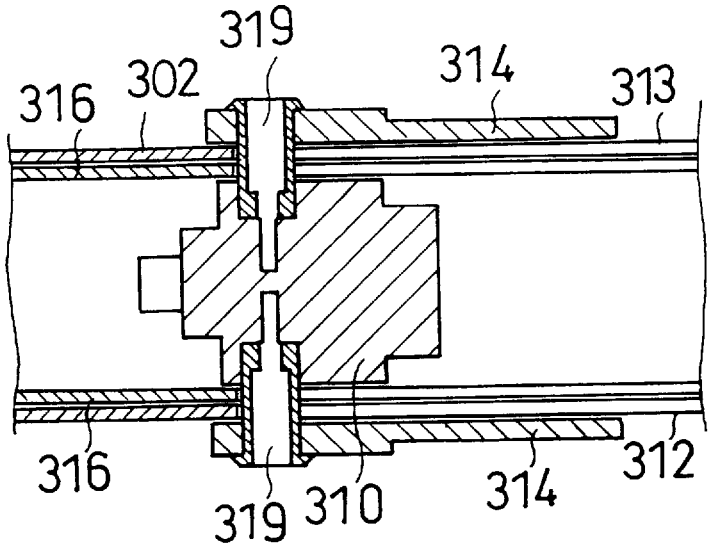
FIG. 16 is a horizontal sectional view of part of the fire extinguisher, showing the hammering section and peripheral parts thereof.

In the internal space of the barrel 302, a hammering section 310 is arranged so as to be axially movable between an inoperative position (FIG. 10) at which the section 310 is separated from the bottom of the cylinder 301, and an operative position (FIG. 11) at which the section 310 strikes against the bottom of the cylinder, and also a hammer spring 311 is interposed between the hammering section 310 and the rear wall 309 of the barrel for pressing the hammering section 310 toward the operative position. A hammer operating section 314 for moving the hammering section 310 to the inoperative position is axially movably fitted on the upper wall 303 and side walls 312, 313 of the barrel 302. The hammer operating section 314 and the hammering section 310 are coupled to each other by right and left connecting pins 319 (FIG. 16). Each of the connecting pins 319 has an inner end portion buried in the hammering section 310, and has an outer end portion protruding through the slot 320 of a corresponding one of the side walls 312 and 313 to the outside of the barrel 302 and further extending through the hammer operating section 314.

Figure 15:
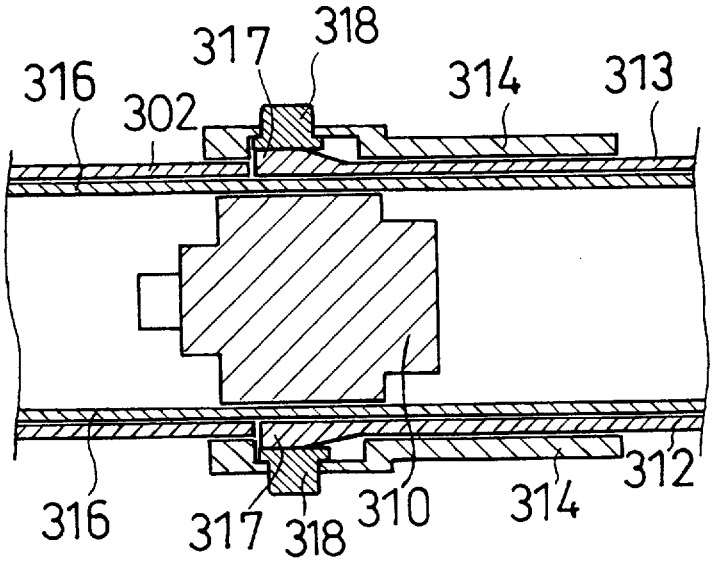
FIG. 15 is a longitudinal sectional view of part of the fire extinguisher, showing a hammering section and peripheral parts thereof.

As shown in FIG. 15, each of the side walls 312 and 313 of the barrel is divided into front and rear halves, and a tongue 317 bulges outward from the front end of the rear half for engagement with the front end of the hammer operating section 314. When the hammer operating section 314 and the tongues 317 are engaged with each other, axial movement of the hammer operating section 314 is inhibited, whereby the hammering section 310 is fixed at the operative position via the connecting pins 319 so that the cylinder 301 may not be moved rearward due to the reaction force of ejected extinguishing gas. Push buttons 318 are irremovably fitted in the hammer operating section 314, and when the tongues 317 are pushed inward through the push buttons 318, they disengage from the hammer operating section 314, permitting rearward movement of the hammer operating section 314.

An annular cylinder withdrawing section 315 is arranged in the internal space of the barrel 302 at a location close to the front wall of the barrel 302, and the front ends of arms 316 are coupled to the withdrawing section 315. The withdrawing section 315 has a center hole 315' through which the cylinder head is inserted. Each arm 316 has an axial slot formed in a rear half thereof, and a corresponding one of the connecting pins 319 engaged with the hammer operating section 314 is inserted through the slot. Accordingly, the connecting pins 319 move within the respective slots of the arms 316 as the hammer operating section 314 is moved rearward, and if, after the connecting pins 319 reach the rear ends of the respective slots, the hammer operating section 314 is further moved rearward, the cylinder withdrawing section 315 and the cylinder 301 are moved rearward via the connecting pins 319 and the arms 316.

The grip 321 supports a first pin 325' arranged at a front portion thereof for rotatably supporting a trigger 325. A first coil spring 324 serving as a first expansion spring is fitted around the pin 325' and has one end coupled to the grip 321 through a pin and the other end engaged with the lower surface of the front end of an upper extended part of the trigger 325. The spring 324 presses the trigger 325 in the clockwise direction, as viewed in FIG. 10, toward an inoperative position thereof. The extended part of the trigger 325 extends forward and can be projected into the internal space of the barrel through an opening formed in the lower wall of the barrel.

A second pin 330' for pivotally supporting a hammer stopper 330 is arranged at a location closer to the rear wall 309 of the barrel than the first pin 325', and is supported by the grip 321. A second coil spring 329 serving as a second expansion spring is fitted round the second pin 330' and has one coupled to the grip 321 through a pin and the other end engaged with the lower surface of a rear end of the hammer stopper 330. The spring 329 presses the stopper 330 in the counterclockwise direction as viewed in FIG. 10. The thickness of the hammer stopper 330 in the height direction thereof increases toward the rear end thereof, and the lower surface of the front end of the stopper 330 is engaged with the upper surface of the rear end of the trigger 325.

Figure 10:
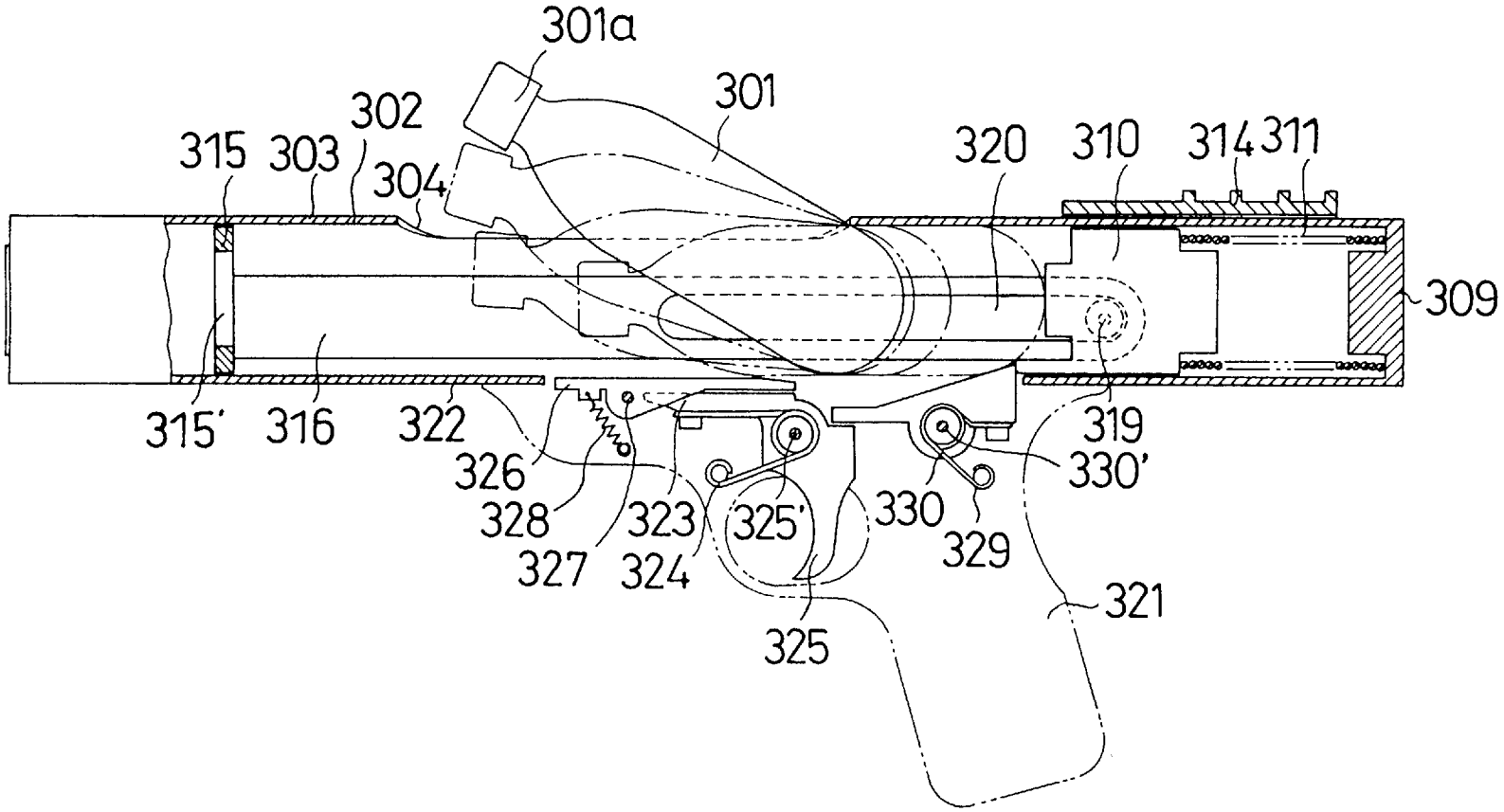
FIG. 10 is a front sectional view of the fire extinguisher of FIG. 8, illustrating how a cylinder is inserted.

As shown in FIGS. 10 and 15, the stopper 330 assumes an operative position in which the rear end thereof projects into the internal space of the barrel through the opening formed in the lower wall 322 and engages with a lower front part of the hammering section 310, thereby holding the hammering section 310 in its inoperative position. The second spring 329 retains the hammer stopper 330 in its operative position. When the trigger 325 is turned counterclockwise toward the operative position, as shown in FIG. 11, the hammer stopper 330 is caused to turn clockwise toward the inoperative position, whereby the engagement of the stopper 330 with the hammering section 310 is released.

Figure 12:
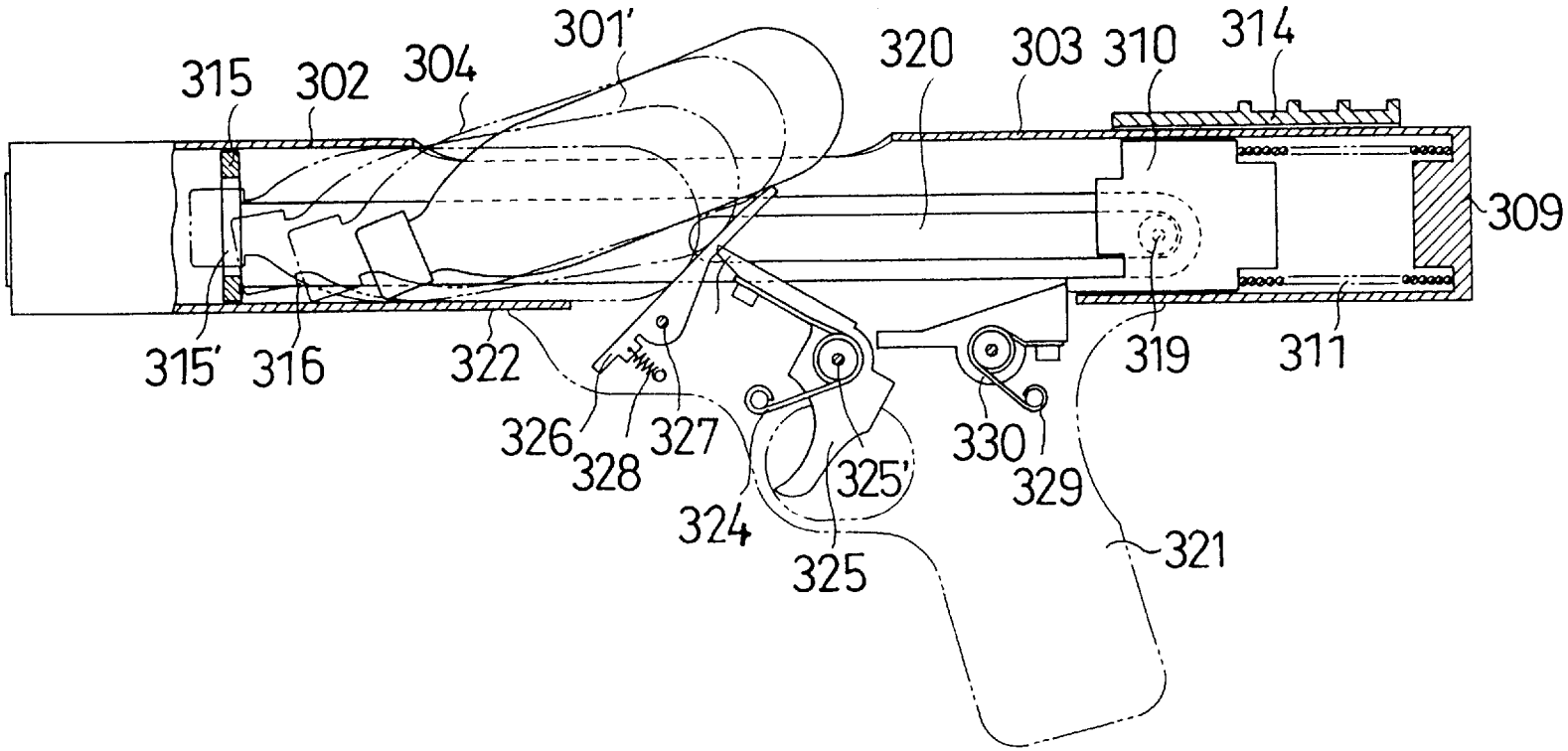
FIG. 12 is a front sectional view of the fire extinguisher from which a cylinder is being forced out.
Figure 13:
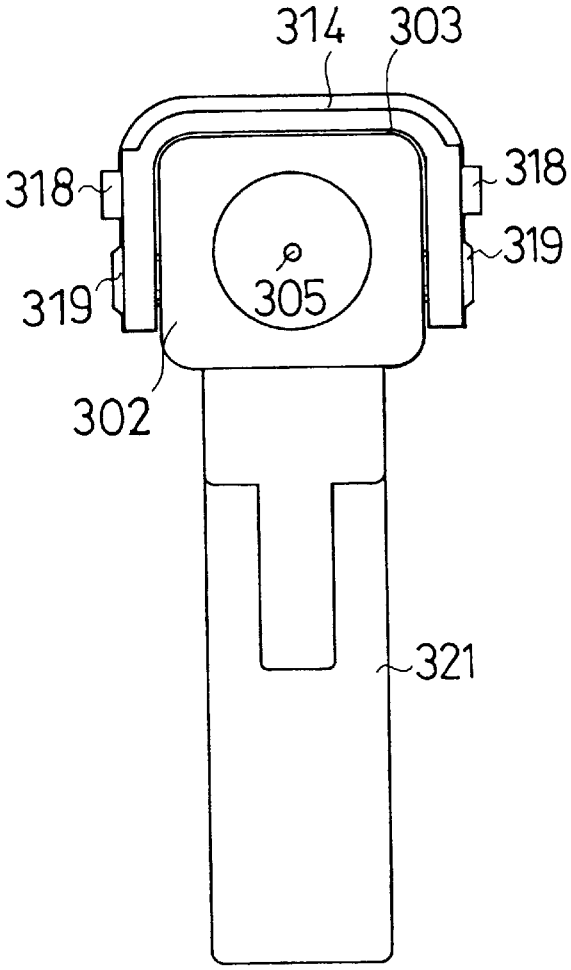
FIG. 13 is a left side view of the fire extinguisher shown in FIG. 8.
Figure 14:
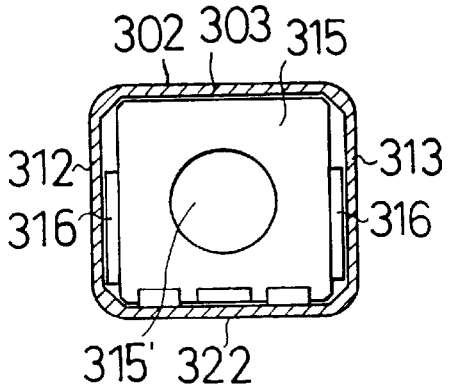
FIG. 14 is a sectional view of a barrel of the fire extinguisher.

A third pin 327 for pivotally supporting a cylinder force-out section 326 is arranged at a location closer to the front wall of the barrel than the first pin 325' and is supported by the grip 321. A front part of the cylinder force-out section 326 is connected to one end of a spring 328, the other end of which is connected to the grip 321 through a pin. The lower surface of a rear part of the cylinder force-out section 326 is disposed for engagement with the upper surface of the extended part of the trigger 325. As shown in FIG. 12, as the trigger 325 is turned clockwise toward the inoperative position while the hammering section 310 is in its inoperative position, the cylinder force-out section 326 is turned counterclockwise by the extended part of the trigger 325 such that the rear part of the force-out section 326 projects into the internal space of the barrel through the opening in the lower wall 322, to thereby push the used cylinder 301' to the outside. Preferably, the fire extinguisher is constructed such that the angle (tilt angle) thus formed between the cylinder force-out section 326 and the longitudinal axis of the barrel 302 is not greater than 90 degrees. Setting the tilt angle to a value not greater than 90 degrees facilitates the replacement of cylinders.

The operation of the gun-type fire extinguisher described above will be now explained.

First, how the cylinder 301 is loaded into the barrel 302 of the fire extinguisher is explained. It is here assumed that the hammering section 310 of the fire extinguisher is in its operative position, as shown in FIG. 15. While depressing the tongues 317 of the side walls 312 and 313 via the push buttons 318 of the hammer operating section 314, the user pulls the operating section 314 toward the rear wall 309 of the barrel, whereupon the hammering section 310 coupled to the operating section 314 by the connecting pins 319 moves rearward against the force of the hammer spring 311.

When the hammering section 310 thus moved toward the rear wall 309 reaches a position rearward relative to the trigger 325, the cylinder force-out section 326 turns counterclockwise on the pin 327 due to the force of the spring 328, and the trigger 325 turns, together with its extended part, clockwise on the pin 325' due to the force of the spring 324. As the extended part of the trigger 325 turns clockwise, the cylinder force-out section 326, which is engaged with the extended part, is further turned counterclockwise. As a result, the rear part of the cylinder force-out section 326 projects into the internal space of the barrel through the opening of the lower wall 322.

When the hammering section 310 is further moved rearward to the inoperative position shown in FIG. 10, the hammer stopper 330 turns counterclockwise due to the force of the spring 329, so that the rear end thereof projects into the internal space of the barrel 302 through the opening of the lower wall 322. As a result, an upper portion of the rear end face of the hammer stopper 330 engages with a lower front surface of the hammering section 310, whereby the hammering section 310 is held in its inoperative position.

While in this state, the user inserts the bottom of the cylinder 301 into the interior of the barrel 302 through the window 304 thereof, as shown in FIG. 10, and while pushing down the cylinder force-out section 326 and the extended part of the trigger 325 with the cylinder 301 against the forces of the springs 328 and 324, loads the entire cylinder 301 into the barrel 302. This completes the cylinder loading.

In the event a fire breaks out, an extinguishing person grabs the grip 321 of the fire extinguisher, then aims the front of the extinguisher at the origin of the fire, and presses the trigger 325 with the finger. As the trigger 325 is pressed, it turns counterclockwise about the pin 325', as viewed in FIG. 10. Simultaneously, the hammer stopper 330, of which the front end engages with the rear end of the trigger 325, turns clockwise about the pin 330' and the engagement between the stopper 330 and the hammering section 310 is released; accordingly, the hammer spring 311 instantaneously expands, and the hammering section 310 moves forward within the barrel 302 and strikes against the rear part of the cylinder 301. Consequently, the cylinder 301 moves forward within the barrel 302 and the head thereof becomes received in the recess 308 formed in the front wall of the barrel 302. Simultaneously with this, the seal plate 301*b* of the cylinder 301 is broken by the striker pin 307 formed on the front wall of the barrel 302, and thus the liquefied gas filled in the cylinder 301 is ejected from the ejection hole 305 formed through the front wall of the barrel 302 in communication with the recess 308. The distance of ejection of the liquefied gas from the fire extinguisher is about 2 m, though it depends upon the quantity of the liquefied gas filled in the cylinder 301. As the liquefied gas thus ejected from the fire extinguisher vaporizes, objects surrounding the extinguishing gas are cooled to a very low temperature of −30° C. to −40° C., and also a large quantity of vaporized gas fills in the room, thus creating an oxygen deficient environment, whereby the fire is extinguished. Since the packing member 301*a* is capped on the head of the cylinder 301, the liquefied gas never leaks into the barrel 302.

The cylinder may be replaced with a new one during or after the fire extinguishing work. When replacing cylinders, the used cylinder 301' is detached in the following manner.

As in the case of loading the cylinder 301 into the barrel 302, the extinguishing person pulls the hammer operating section 314 rearward while depressing the push buttons 318 of the operating section 314. As the operating section 314 is moved rearward, the hammering section 310 also moves rearward. As a result, the cylinder force-out section 326 is allowed to turn counterclockwise, and the trigger 325 and the extended part thereof are allowed to turn clockwise.

When the hammering section 310 is considerably moved rearward, the connecting pins 319 become engaged with the rear ends of the respective slots of the arms 316. As the hammering section 310 is further moved rearward, the arms 316 and the cylinder withdrawing section 315 connected to the front ends of the arms 316 move rearward, and then the withdrawing section 315 is abutted against the shoulder of the used cylinder 301'. Thereafter, with further rearward movement of the hammering section 310, the withdrawing section 315 and the used cylinder 301' move rearward, and as shown in FIG. 12, the rear part of the cylinder force-out section 326 turns counterclockwise and pushes the used cylinder 301' upward. Also, the rear end of the hammer stopper 330 engages with the front lower part of the hammering section 310 and holds the section 310 in its inoperative position.

The extinguishing person then grasps the thus-raised cylinder 301' with the hand and detaches it from the barrel 302 through the window 304. After the used cylinder 301' is removed, the extinguishing person loads a new cylinder 301 into the barrel 302 in the manner described above.

According to the fire extinguisher of this embodiment, the extinguishing person can perform fire extinguishing work easily by grabbing the grip 321 and then pressing the trigger 325, and the fire extinguisher can be accurately aimed at the origin of fire. Further, the cylinder 301 never jumps out of the fire extinguisher due to the reaction force of ejected extinguishing gas, and the cylinder replacement is easy. The fire extinguisher of this embodiment is small in size, lightweight, and handy for fire extinguishing work.

The present invention is not limited to the first to fourth embodiments, and various modifications may be made.

For example, in the second embodiment, the extinguisher body is composed of the inner and outer fixing sections 123 and 106 coupled to each other via the cover (hollow cover) 117, and the lower cover 108. Alternatively, the extinguisher body may be composed of a single member opening at one end thereof corresponding to the bottom of the cylinder. In this case, the hollow cover is fitted on the outer peripheral surface of a portion of the extinguisher body corresponding to the head of the cylinder.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A fire extinguisher comprising:

a fixing member for supporting a cylinder filled with fire-extinguishing gas, said fixing member having a peripheral wall in which a cylinder mounting section for receiving a head of the cylinder, a stepped hole and an extinguishing gas ejection hole are formed;

a needle supporting member axially movably arranged in the stepped hole and the cylinder mounting section of said fixing member, said needle supporting member including a collar arranged in the cylinder mounting section and having a larger diameter than the stepped hole, and a needle arranged on the collar so as to face a seal plate provided on the head of the cylinder for breaking the seal plate;

a spring arranged in the stepped hole of said fixing member between a shoulder of the stepped hole and the collar of said needle supporting member for pressing said needle supporting member toward the cylinder;

a spring cotter pin both compressible and expandable, said spring cotter pin serving to, when compressed, hold said needle supporting member in an initial position in which the needle is separated from the seal plate of the cylinder, against a force exerted by said spring; and a fusible cap fitted on said fixing member for holding said spring cotter pin in a compressed state, said spring cotter pin being allowed to expand when said fusible cap is heated and melted, thereby allowing axial movement of said needle supporting member, whereby the needle breaks the seal plate of the cylinder.

2. The fire extinguisher according to claim 1, wherein said fusible cap is made of a material which is melted when heated to a predetermined temperature.

3. The fire extinguisher according to claim 1, wherein said fusible cap has an indentation cut in a peripheral wall thereof; said spring cotter pin is U-shaped and has two legs projecting to outside of said fusible cap through the indentation, each of the legs being abutted against a corresponding one of edges of the indentation of said fusible cap when said fusible cap is not melted.

* * * * *